US005649444A

United States Patent [19]

Nilsson et al.

[11] Patent Number: 5,649,444

[45] Date of Patent: *Jul. 22, 1997

[54] TOOL PROVIDED WITH A MARKING DEVICE

[75] Inventors: Mikael Nilsson; Mats Norin, both of Älvdalen, Sweden

[73] Assignee: Pressmaster Tool AB, Alvdalen, Sweden

[ * ] Notice: The term of this patent shall not extend beyond the expiration date of Pat. No. 5,509,291.

[21] Appl. No.: 525,540

[22] PCT Filed: Feb. 21, 1994

[86] PCT No.: PCT/SE94/00143

§ 371 Date: Aug. 17, 1995

§ 102(e) Date: Aug. 17, 1995

[87] PCT Pub. No.: WO94/19154

PCT Pub. Date: Sep. 1, 1994

[30] Foreign Application Priority Data

Feb. 19, 1992 [SE] Sweden ..... 9300564

[51] Int. Cl.[6] ..... H01R 43/042

[52] U.S. Cl. ..... 72/409.12; 81/313; 72/409.14

[58] Field of Search ..... 72/409.12, 409.14, 72/409.01, 451; 81/313

[56] References Cited

U.S. PATENT DOCUMENTS

| | | | |
|---|---|---|---|
| 2,088,054 | 7/1937 | Crosman | 74/17.5 |
| 3,126,772 | 3/1964 | Haucke | 81/313 |
| 3,157,075 | 11/1964 | Filia . | |
| 3,170,345 | 2/1965 | Poingt . | |
| 4,170,154 | 10/1979 | Izraeli | 81/313 |
| 5,509,291 | 4/1996 | Nilsson | 81/313 |

FOREIGN PATENT DOCUMENTS

| | | |
|---|---|---|
| 0417025 | 3/1991 | European Pat. Off. . |
| 2602491 | 10/1976 | Germany . |
| 2555071 | 6/1977 | Germany . |
| 1522144 | 8/1978 | United Kingdom . |
| 2251568 | 7/1992 | United Kingdom . |

*Primary Examiner*—Daniel C. Crane

*Attorney, Agent, or Firm*—Jacobson, Price, Holman & Stern, PLLC

[57] ABSTRACT

A tool is provided with two jaws (16, 17) which are movable between an open position and a closed position, means (19, 20, 22) for transmitting movement to the jaws, and a marking device (3–8, 10) for the indication of a completed jaw movement and/or the prevention of a premature interruption of an initiated jaw movement. The marking device includes a cam (3) and a cam follower (7) which are carried by an associated movement transmitting means or an associated jaw. The cam follower (7) projects outwardly of and is mounted for movement along a U-shaped or V-shaped slot (10) which is arranged in an associated movement transmitting means or jaw adjacent the cam and the legs of which extend obliquely away from the cam (3) and the base-part of which is at least partially covered by the cam when the jaws are in a position between the open position and the closed position. The cam surface (6) is arcuate and smooth or toothed. The means or jaw carrying the cam (3) can be pivoted about a pivot centre (23) which coincides with the centre of the arc.

4 Claims, 2 Drawing Sheets

TOOL PROVIDED WITH A MARKING DEVICE

This application is a 371 of PCT/SE94/00143, filed Feb. 21, 1994.

There is often a need to know whether or not a predetermined movement of a first part relative to a second part has been completed. Although not exclusively the case, this applies in particular to certain types of crimping tools, for instance tools intended for crimping terminal contacts onto electrical conductors, where a given crimping jaw movement must be executed in order to be able to guarantee that a reliable connection has been achieved between the conductor and the contact. Devices which function to prevent an interruption in such firm crimping operations prior to being completed have long been known to the art, for instance from GB-A-1,552,144, DE-C-2,555,071, DE-B-2,602,491 and also from U.S. Pat. Nos. 3,157,075 and 3,170,345. With the intention of quaranteeing that such movement will be completed, the known devices normally include a straight or curved toothed rack and a spring-biassed latching pawl which engages with the rack. Incorporation of the latching pawl, and particularly the spring arrangement, in the tool can sometimes create problems. More particularly, in the case of certain, otherwise favourable tool constructions, the pawl biassing spring may be accessible to foreign objects. For instance, the spring may be damaged by up-wardly protruding parts of objects with which it comes into contact when the tool is placed carelessly on a workbench.

The object of the present invention is to provide a novel and advantageous device of the kind mentioned in the introduction which can be constructed to indicate solely when a predetermined movement has been completed, or at the same time to prevent interruption of the predetermined movement prior to said movement being completed, and which device can be incorporated in a tool in a manner such as to essentially minimize the risk of damage should the tool be handled in a careless manner.

Further characteristic features of the invention and advantages afforded thereby will be apparent from the following description of a number of exemplifying embodiments of the invention made with reference to the accompanying drawings.

Figure 1:
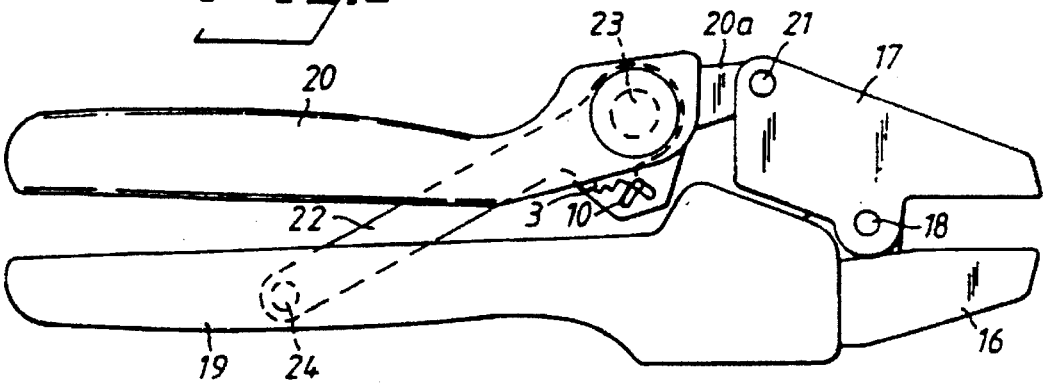
FIGS. 1 and 2 are respectively a side view and a top yew of an inventive crimping tool provided with a marking device.

Those elements in the drawings which coincide or essentially coincide with one another have been identified in the various Figures with the same reference signs.

Figure 2:
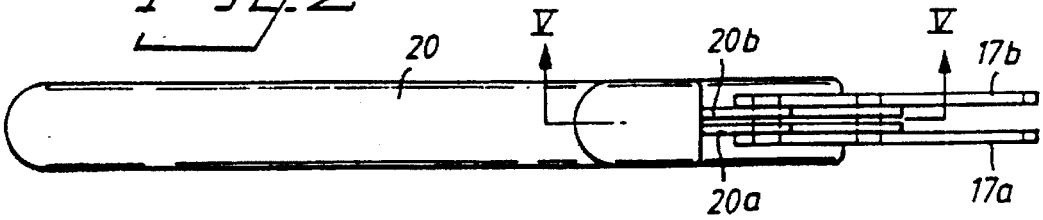

FIGS. 1 and 2 illustrate in a closed position a crimping tool for performing crimping operations and comprising first and second jaws 16, 17 which are intended to support jaw inserts (not shown) for crimping terminal contacts onto electrical conductors for instance. The jaws 16, 17 are journalled at a first pivot point 18 for pivotal movement relative to one another between the illustrated, closed position and an open position (not shown) which enables, for instance, a cable end and a terminal contact which is to be crimped onto said cable end to be inserted between the inserts carried by the open jaws. The tool also includes a respective first and second handle referenced generally 19 and 20, which extend rearwardly from the jaws 16, 17. Each handle is comprised of a metal body which in the regions intended to be held by the user during a crimping operation are provided with outer coverings or outer handles, which are preferably made of a plastic material for instance and have a grip-friendly shape. The first handle 19 is connected rigidly to the first jaw 16. A forward end of the second handle 20 is pivotally connected to the second jaw 17 at a second pivot point 21, this second pivot point being located rearwardly of the first pivot point 18. A pressure force transmitting linkage construction 22 extends obliquely rearwards from a third pivot point 23 which is located on the second handle 20 rearwardly of the second pivot point 21, and to a fourth pivot point 24 located on the first handle 19.

The metal handle-bodies of the tool, of which the body of the handle 20 is shown at 20*a*, 20*b*, are located in mutually the same plane in the case of the tool illustrated in FIGS. 1 and 2, and are comprised of two flat parts which are located adjacent one another at a small distance apart. The linkage construction 22 is comprised of two similarly flat, mutually identical linkage arms, each of which is located on a respective side of the handle bodies and of which the linkage arm closest to the viewer of FIG. 1 hides the linkage arm located behind the linkage arm that is visible in the Figure.

The first jaw 16 includes two plates which are fixedly connected on a respective side of the associated handle body. A crimping part (not shown) is intended to be fixed between said plates. Similarly, the second jaw 17 includes two plates 17*a*, 17*b* which are each intended to be located on a respective side of the handle body 20*a*, 20*b* (see in particular FIG. 2), said plates being pivotally journalled and intended to fix a crimping part (not shown) therebetween. The construction of the tool components in the form of flat or plate-like elements is favourable from the aspect of mechanical strength. A pull spring (not shown) strives to swing the jaw 17 anti-clockwise around the pivot point 18, and therewith to swing the handle 20 clockwise around the pivot point 23.

In order to prevent interruption of a crimping operation before the jaws 16, 17 have been swung to a fully closed position, or in order to prevent the interruption of a tool opening movement, the linkage arms included in the linkage construction 22 are provided with parts 1 having cams 3. As will best be seen from FIGS. 3 and 4, these parts have a toothed camming surface 6 which is curved arcuately and the centre point of which is located in the pivot point 23. The cams 3 coact with a cam follower 7, here in the form of a cylindrical pin carried by a part 2 of the handle body 20*a*, 20*b*. The cam follower 7 projects outwardly of and is mounted for movement along an essentially V-shaped slot 10 in the part 2 adjacent the cam 3. The legs of the slot 10 extend obliquely away from the cam 3. When that portion of the part 2 which carries the slot 10 is located between the cam end-parts 4, 5, the cam 3 covers the bottom-part of the slot 10. Thus, when the part 2 moves relative to the part 1 to the left in FIGS. 1 and 3, the cam follower 7 is cammed by the cam end-part 4 into the rearward leg of the slot 10. The cam follower 7 is held constantly in contact with the camming surface by the spring force 8. When the movement has been completed and the slot 10 has reached the position shown in FIG. 4, the cam follower 7 snaps into contact with the base-part of the V-shaped slot 10. For this purpose a spring 8 mounted between the cam follower 7 and the pivot point or pivot pin 23 and strives to pull the cam follower into contact with the base-part of the V-shaped slot. It will be seen that the cam follower 7 must be located forwardly or rearwardly of the ends of the cam 3 before the tool can be opened and closed respectively.

The tool illustrated in FIGS. 1 and 2 is opened automatically by the pull spring (not shown) acting between the jaw 17 and the handle 19. When performing a crimping operation, the articles concerned, for instance a terminal contact to be crimped onto the bared end of a cable, are inserted between the crimping parts (not shown) carried by the fully opened jaws 16, 17, the handle 20 being swung upwards from the position illustrated in FIG. 1 in the manner illustrated in FIG. 4. While holding the articles manually in position between the jaws, the handles 19, 20 are swung towards one another until the camming device 7 is located forwardly of the camming surface 6, wherewith the crimping operation is completed. It will be seen that the linkage construction 22 and the pivotal handle 20 together form a toggle mechanism which when the handle 20 is swung anti-clockwise with a moderate force will cause the other jaw 17 to swing clockwise with a greater force during a crimping operation.

Figure 3:
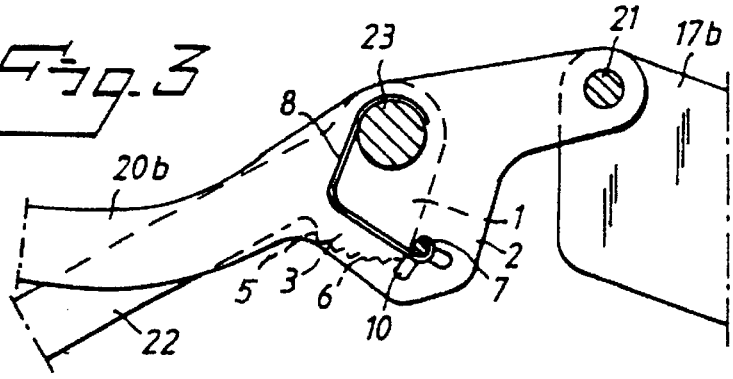
FIGS. 3 and 4 are sectional views in lager scale and taken essentially on the line V—V in FIG. 2, and illustrate the construction of the marking device in the tool illustrated in FIGS. 1 and 2.
Figure 4:
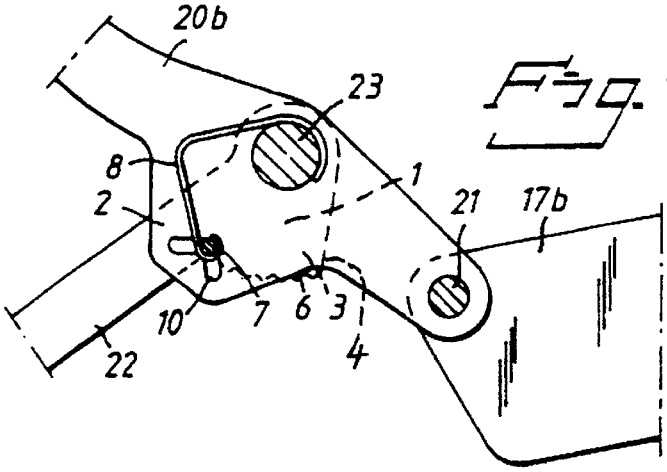

As before mentioned, FIGS. 3 and 4 are sectional views of the indicating or marking device taken on the line V—V in FIG. 2. The section is thus taken between the body parts of the handle 20 so that only the body part **20*b* and the one linkage arm 22 located therebeneath are visable. Both this linkage arm and the upper linkage arm (not shown in FIGS. 3 and 4) are provided with mutually opposite slots 10. The cam follower 7 extends through the two linkage arms and the opposite ends of the cam follower coact with respective toothed camming surfaces 6 on each of the parts 1 of the linkage arms. The spring 8 is located between the mutually covering body parts 20*a*, 20*b*** and is thus fully protected thereby.

Figure 5:
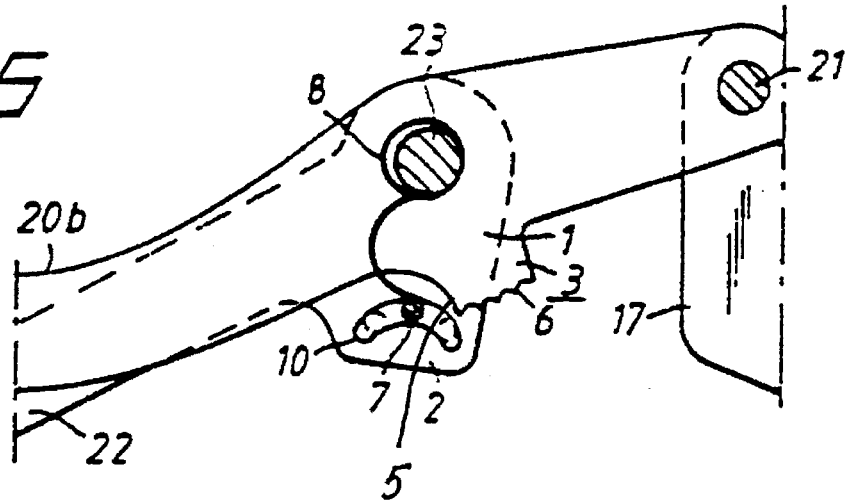
FIGS. 5 and 6 are views similar to the views of FIGS. 3 and 4 and illustrate alternative embodiments of the marking device.
Figure 6:
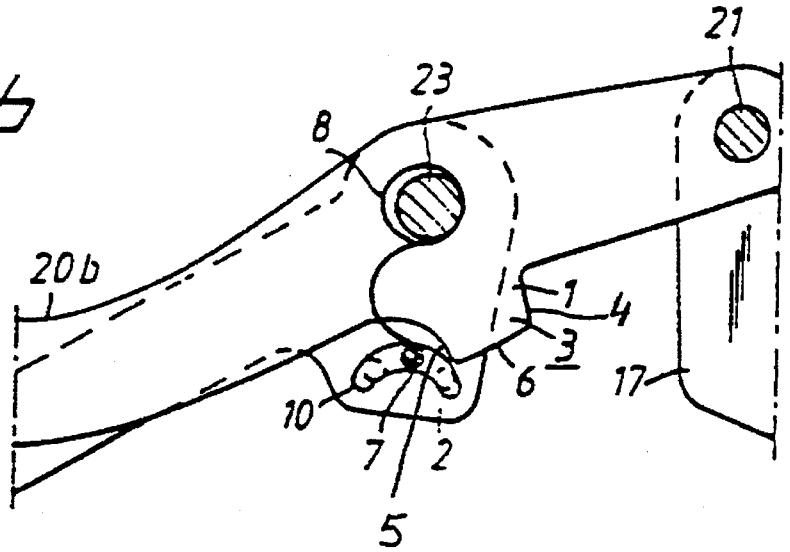

FIGS. 5 and 6 are views similar to FIG. 3. The cam 3, however, is mounted on the handle body **20*a*, 20*b*, whereas U-shaped slots 10 are disposed in the parts 2 of the linkage construction 22. The cam follower 7 is guided at opposite ends thereof in the slots 20 in the linkage parts 2, while the centre part of the cam follower is intended to coact with the cam 3 on the handle body 20*a*, 20*b* located between the linkage arms. Respective section views of FIGS. 5 and 6 are taken in the same way as the section views of FIGS. 3 and 4, and consequently only the bottom linkage arm and the body part 20*b* located nearest thereto can be seen. The spring 8 acting between the cam follower 7 and the pivot pin 23 is fully protected between the body parts 20*a*, 20*b*. The cam surface 6 of the FIG. 5 embodiment is toothed, whereas the cam surface of the FIG. 6** embodiment is smooth and serves to indicate, acoustically and/or visually, that a tool movement has been completed, but does not prevent an interruption of said movement prior to its completion.

The invention is not restricted to the aforedescribed and illustrated embodiments, but can be realized in any desired manner within the scope of the inventive concept defined in the following claims.

We claim:

1. A tool comprising:

two jaws movable between an open position and a closed position, means for transmitting movement to the jaws, and a marking device for indicating that a jaw-opening or jaw-closing movement has been completed and/or preventing an interruption of said movement prior to completion, said marking device including a cam having a height decreasing comparatively abruptly at mutually opposite ends thereof and being carried by a first one of said movement transmitting means or a first one of the jaws, and a cam follower carried by another of said movement transmitting means or by another of said jaws and said cam follower, at an initial stage of the jaw movement, is located at a first end-part of the cam and, at a final stage of the jaw movement, is located at the other end-part of the cam, said cam follower being spring-biassed into contact with the cam, the cam follower being pin-shaped and projecting outwardly of and mounted for movement along an essentially U-shaped or V-shaped guide or slot arranged in said other movement transmitting means or jaw adjacent the cam and the legs of which extend away from the cam and the base-part of which is at least partially covered by the cam when the jaws are located in a position between said initial and said final stages; the cam follower being intended to be cammed in said movement stages by said cam end-parts into the rearward leg of the U-shaped or V-shaped slot, as seen in the relative direction of movement of said other means or said other jaw, and to be held therein by an intermediate camming surface extending between said cam end-parts, until said movement has been completed, said intermediate camming surface being at least generally arcuate and smooth or toothed, the means or jaw carrying said cam being pivotal about a pivot centre coinciding with a centre point of the arc.

2. A tool according to claim 1, wherein the movement transmitting means are in the form of first and second handles extending rearwardly from the jaws, and a linkage construction has ends pivotally connected to a respective one of the handles, and the cam is mounted on the linkage construction and the cam follower is mounted on one of the handles or vice versa, and at least one of the handles is pivotally connected to an associated jaw.

3. A tool according to claim 2, wherein said first and second handles include handle bodies located in a same plane and the linkage construction includes two mutually parallel linkage arms, each of which is located on a respective side of said handle bodies, and the cam follower is mounted in the U-shaped or V-shaped slot in a part of and projects out from both sides of the body of said handle which is pivotally connected to said associated jaw and parts of linkage arms of said linkage construction each have cam parts located on a respective side of the linkage arm for engagement with the cam follower and which are at least generally arcuate with a centre of curvature located on a linkage arm pivot on the body of said handle.

4. A tool according to claim 3, wherein at least the body of said handle which is pivotally connected to said associated jaw is comprised of two mutually parallel body parts spaced slightly apart and which contain mutually opposing, essentially U-shaped or V-shaped slots through which the cam follower extends and a spring acts between the cam follower and a pivot pin by means of which the linkage arms are journalled to the body of said handle, is located between the body parts and strives to hold the cam follower in engagement with a base-part of the U-shaped or V-shaped slot.

* * * * *